US006195813B1

(12) United States Patent
Orcini

(10) Patent No.: US 6,195,813 B1
(45) Date of Patent: Mar. 6, 2001

(54) COLLAPSIBLE SHOWER CHAIR

(76) Inventor: Mario G. Orcini, 10301 Lake Ave., Apt. #705, Cleveland, OH (US) 44102

( * ) Notice: Subject to any disclaimer, the term of this patent is extended or adjusted under 35 U.S.C. 154(b) by 0 days.

(21) Appl. No.: 09/411,002

(22) Filed: Oct. 1, 1999

(51) Int. Cl.[7] ..... A47K 3/022
(52) U.S. Cl. ..... 4/578.1; 108/145; 297/16.1
(58) Field of Search ..... 4/578.1, 579; 108/9, 108/145

(56) References Cited

U.S. PATENT DOCUMENTS

| | | | | |
|---|---|---|---|---|
| 527,017 | * | 10/1894 | Fry | 108/9 |
| 1,335,857 | * | 4/1920 | Robbins | 108/9 |
| 1,712,704 | | 5/1929 | Kiser . | |
| 1,923,482 | | 8/1933 | Frankenstein . | |
| 1,975,857 | * | 10/1934 | McKenney | 108/9 |
| 2,560,679 | * | 7/1951 | Zalkind | 108/9 |
| 3,458,876 | | 8/1969 | Struthers . | |
| 3,579,668 | | 5/1971 | Aronovitz . | |
| 3,995,331 | * | 12/1976 | Fotre et al. | 4/579 X |
| 5,097,542 | | 3/1992 | Roesler . | |
| 5,185,892 | * | 2/1993 | Mitchell | 4/578.1 X |
| 5,551,100 | | 9/1996 | Kindrick . | |
| 5,606,751 | | 3/1997 | Baker . | |

* cited by examiner

*Primary Examiner*—Charles E. Phillips
(74) *Attorney, Agent, or Firm*—James A. Hudak

(57) ABSTRACT

A collapsible shower chair is disclosed. The shower chair has a plurality of suction cups on an edge of the seat portion thereof permitting the chair to readily grip the wall of the shower stall when not in use. Each suction cup is received within a longitudinally extending slot in the seat portion of the chair and is readily movable therein permitting alignment of the suction cup with the surface of the wall of the shower stall. A ball and detent arrangement is provided for engagement of a support arm with the seat portion of the chair ensuring that the legs are firmly attached to the seat portion when the chair is in use.

7 Claims, 3 Drawing Sheets

COLLAPSIBLE SHOWER CHAIR

TECHNICAL FIELD

The present invention relates, in general, to a chair that can be readily used within a shower and, more particularly, to a shower chair that is readily collapsible upon itself for storage purposes.

BACKGROUND ART

Shower chairs or seats permit the user to be seated, rather than standing, while taking a shower or while coloring or conditioning one's hair while showering. Such chairs or seats, however, are typically not readily storable when not being used. This creates a problem in small bathrooms such as those which are usually present in apartments in large cities where space is at a premium. In such instances, a non-collapsible chair takes up an excessive amount of space which is very impractical.

In order to overcome this problem, some shower chairs or seats are permanently attached to the wall of the shower stall or to the wall adjacent the bathtub in a bathtub-shower combination. For example, U.S. Pat. No. 3,579,668 (Aronovitz) discloses a bath or shower seat in the form of a panel which is hingedly attached to the wall adjacent the bathtub. The panel is supported by the top surface of the bathtub and, when not in use, can be moved into an upward position so as to be adjacent the wall surrounding the bathtub. U.S. Pat. No. 5,551,100 (Kindrick) discloses a bath bench in the form of a panel which is hingedly attached to the wall adjacent the bathtub and is supported by the top surface of the bathtub when the panel is in the downward position. The bench disclosed in this latter patent differs from the seat disclosed in U.S. Pat. No. 3,579,668 (Aronovitz) in that includes a storage catch member attached to the wall adjacent the bathtub to secure the panel in the vertical position when not in use. U.S. Pat. No. 1,923,428 (Frankenstein) discloses a bench or chair for a bathtub and differs from the seats or benches disclosed in the aforementioned patents in that the bench or chair is self-storing within the wall adjacent the bathtub. Thus, the chairs or seats disclosed in all of the aforementioned patents overcome the storage problem by being hingedly attached to the wall adjacent the bathtub or by providing a compartment within the wall for the storage of the chair when not in use. In any event, the chair is permanently mounted to the bathtub or shower stall enclosure and cannot be readily removed therefrom or replaced, if necessary.

In view of the foregoing, it has become desirable to develop a shower chair which is readily collapsible upon itself and which can be stored within the shower stall when not in use.

SUMMARY OF THE INVENTION

The present invention solves the problems associated with storing shower chairs or benches and other problems by providing a collapsible shower chair which has a plurality of suction cups on an edge thereof permitting the chair to readily grip the wall of the shower stall when not in use. Each suction cup is received within a longitudinally extending slot in a side member of the seat portion of the chair and is readily movable therein permitting alignment of the cup with the surface of the tiles forming the walls of the shower stall. A ball and detent arrangement is provided for engagement of a leg support arm with the seat portion ensuring that the legs are firmly attached to the seat portion when the chair is in use, and also permitting the seat portion to become disengaged from the leg support arm when the chair is not in use.

DESCRIPTION OF THE PREFERRED EMBODIMENT

Figure 1:
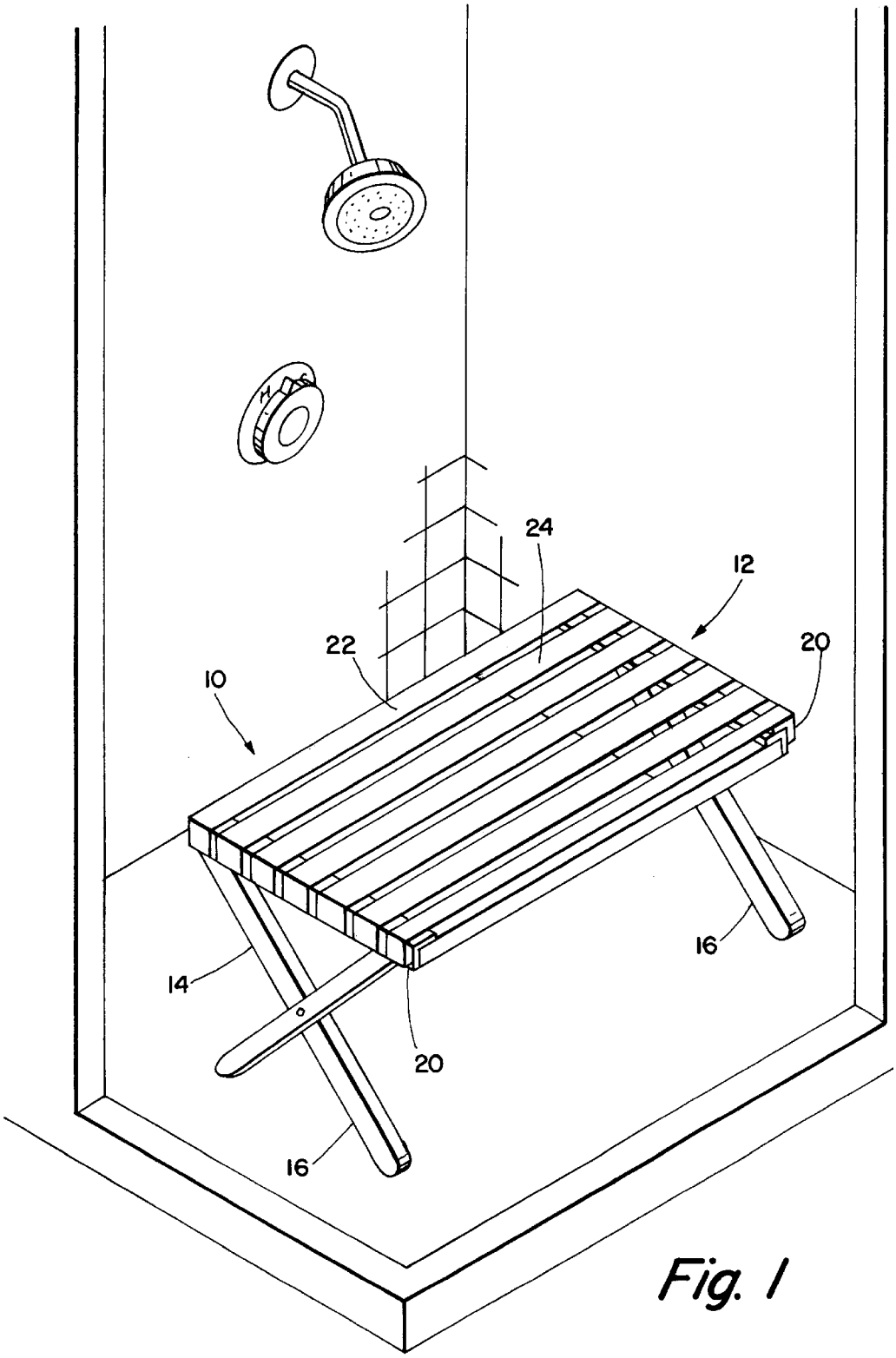
FIG. 1 is a perspective view of the shower chair of the present invention showing its placement within a shower stall.
Figure 2:
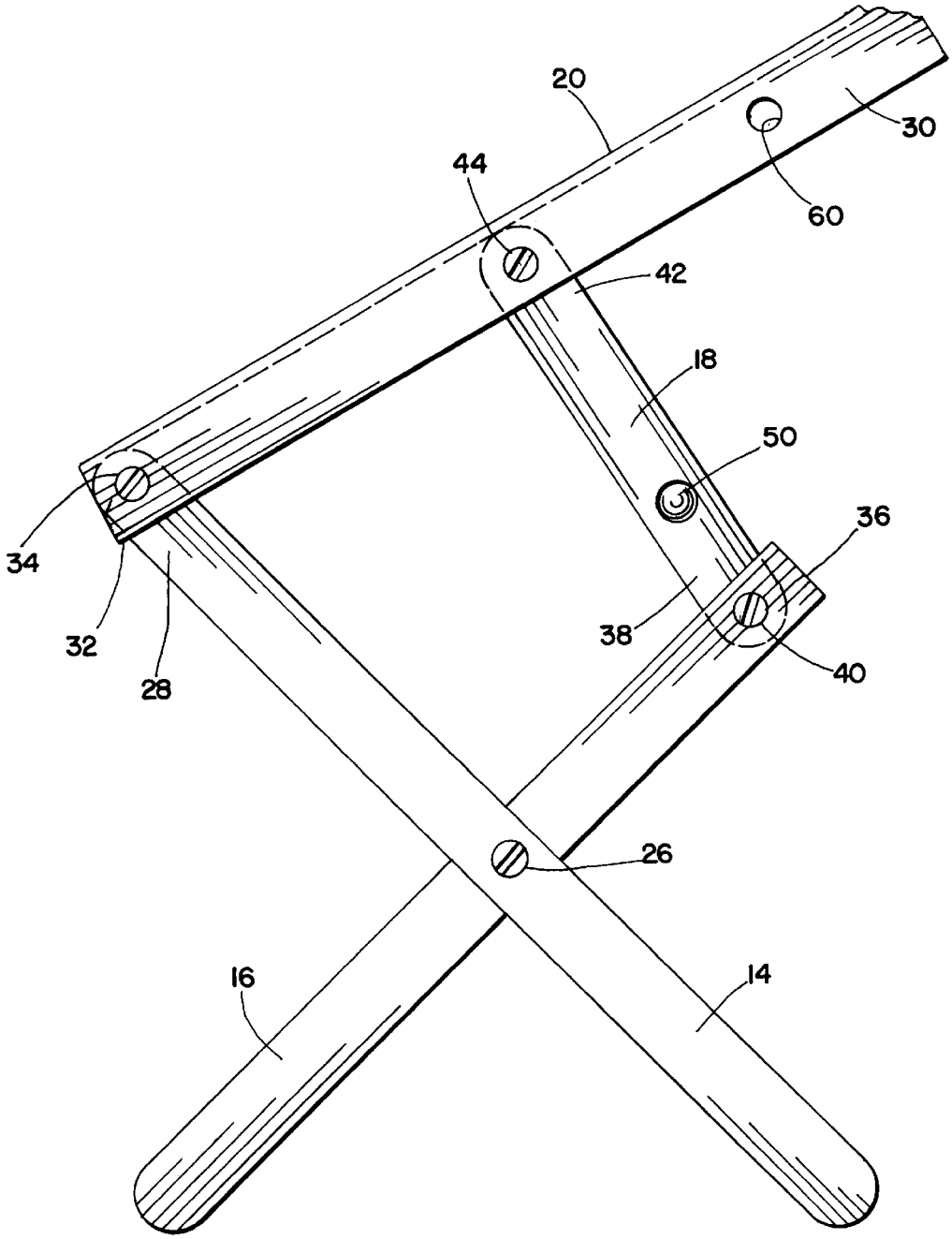
FIG. 2 is an enlarged view of the leg portions and the seat portion of the shower chair of the present invention.

Referring now to the drawings where the illustrations are for the purpose of describing the preferred embodiment of the present invention and are not intended to limit the invention described herein, FIG. 1 is a perspective view of the shower chair 10 of the present invention The shower chair 10 is comprised of a seat member 12, a first leg member 14, a second leg member 16 and a support arm 18 which pivotally interconnects second leg member 16 with seat member 12. The seat member 12 is comprised of oppositely disposed L-shaped end members 20, oppositely disposed longitudinally extending side members 22 and a plurality of longitudinally extending slats 24 interconnecting the L-shaped end members 20 and oriented so as to be substantially parallel to the side members 22. As shown in FIG. 2, the first leg member 14 and the second leg member 16 are pivotally attached to one another by a pin 26 which passes through their respective approximate midpoints. End 28 of first leg member 14 is pivotally attached to the inner surface of leg portion 30 of L-shaped end member 20 adjacent its end 32 by a pin 34. End 36 of second leg member 16 is pivotally attached to end 38 of support arm 18 by a pin 40 which passes therethrough. The opposite end 42 of support arm 18 is pivotally attached to the inner surface of leg portion 32 of L-shaped end member 20 by a pin 44 which is located in a spaced apart relationship with respect to pin 34.

Figure 3:
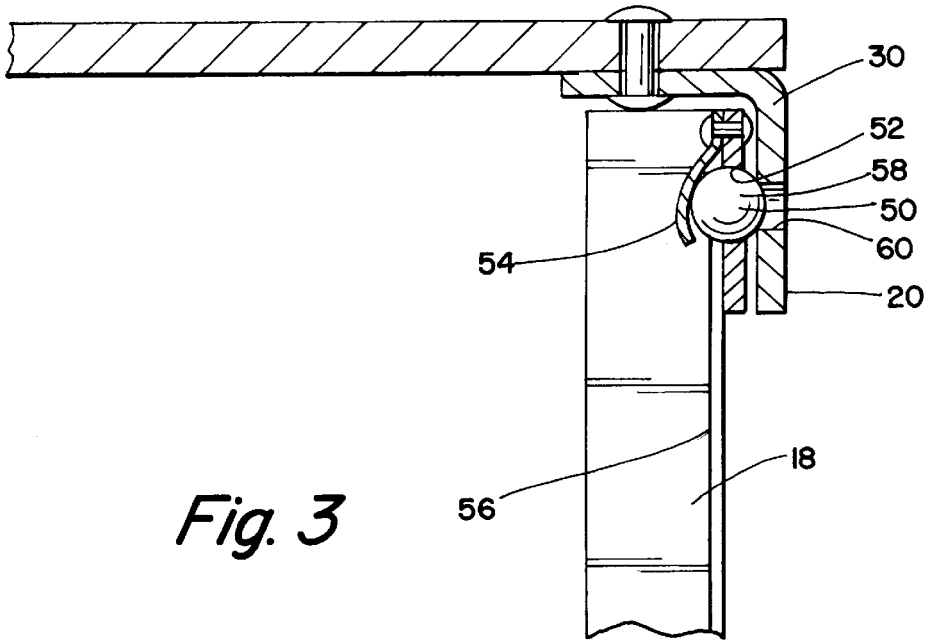
FIG. 3 is an enlarged view of the ball and pocket arrangement utilized to secure the leg portions to the seat portion of the shower chair of the present invention.
Figure 4:
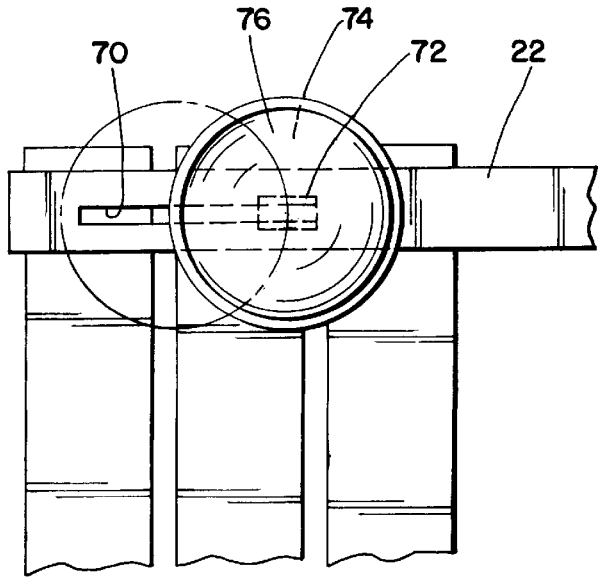
FIG. 4 is an enlarged view of the suction cups within the side member of the seat portion of the shower chair of the present invention.

Referring now to FIG. 3, a ball 50 is retained in an aperture 52 provided in support arm 18 by means of a leaf spring 54 attached to the inner surface 56 of support arm 18. In this manner, a portion 58 of ball 50 protrudes outwardly through aperture 52. A complementary pocket 60 is provided in leg portion 30 of L-shaped end member 20 to receive portion 58 of ball 50. When the seat member 12 of shower chair 10 is in position for use, portion 58 of ball 50 is received within pocket 60 in leg portion 30 of L-shaped end member 20, thus securing the seat member 12 to support arm 18 and ensuring that first leg member 14 and second leg member 16 are in the proper spread-apart open relationship.

One of the side members 22 is provided with a plurality of spaced-apart, longitudinally extending slots 70 for receipt of a hub 72 provided on the rear surface 74 of suction cups 76 as shown in FIG. 3. Hub 72 is substantially rectangular in cross-section and the width of its shorter side is slightly less than the width of the longitudinally extending slot 70 whereas the width of its longer side is slightly greater than the width of longitudinally extending slot 70. In this manner, suction cup 76 can be moved laterally within longitudinally extending slot 70 to the approximate desired position within same and can then be rotated approximately 90 degrees so as to lock same within the longitudinally extending slot 70.

In use, the shower chair 10 is placed within the shower stall so that the bottom of its first and second leg members 14, 16 contact the floor of the shower stall and the seat member 12 of the chair 10 is oriented in a horizontal plane so that the ball 50 in support arm 18 is received within pocket 60 in leg portion 30 of L-shaped end member 20. The ball 50 is retained within the pocket 60 by leaf spring 54. In this manner, a person can sit comfortably within a shower stall when showering. When the person has completed showering, the seat member 12 of the chair 10 can be rotated with respect to first leg member 14 causing the ball 50 to become disengaged from the pocket 60 in leg portion 30 of L-shaped end member 20 allowing the chair 10 to be collapsed upon itself The chair 10 can then be readily stored by placing same against a wall of the shower stall. The suction cups 76 can be pressed against the wall causing the chair 10 to be securely retained against same until future use. The position of the suction cups 76 within longitudinally extending slots 70 can be readily changed to compensate for differences in the width of tiles forming the wall of the shower stall and for the positioning of grout lines between adjacent tiles. In this manner, the chair 10 can be securely stored out of the way and protrudes only approximately one and one-half inches from the wall of the shower stall permitting a person taking a shower to have the option of whether or not to use the chair.

The chair 10 requires no particular maintenance or cleaning and, unlike other chairs presently available, easily retracts and stores in the shower stall or the area of the bathtub. Thus, the chair 10 does not have to be removed from the shower stall and can be readily stored within same when not being used. Therefore, it does not take up additional space in small bathrooms, particularly those present in apartments in large cities where space is at a premium. Thus, the chair would be definitely attractive to those individuals living in small apartments or the like Certain modifications and improvements will occur to those skilled in the art upon reading the foregoing. It is understood that all such modifications and improvements have been deleted herein for the sake of conciseness and readability, but are properly within the scope of the following claims.

I claim:

1. A chair comprising a seat member, a set of first leg members oriented in a spaced-apart relationship, a set of second leg members oriented in a spaced-apart relationship, each of said first leg members being pivotally attached to a second leg member, each of said first leg members being pivotally attached at one end thereof to said seat member, a support member interconnecting said second leg member at one end thereof to said seat member, means for securing said seat member to said support member, and means for securing the chair to a surface when the chair is not in use.

2. The chair as defined in claim 1 wherein said seat member securing means comprises a ball member received within an aperture in said support member, a detent provided within said seat member and means for biasing said ball member into said detent in said seat member.

3. The chair as defined in claim 1 wherein said means for securing said chair to a surface comprises at least one suction cup received within said seat member.

4. The chair as defined in claim 3 wherein said seat member is provided with a longitudinally extending slot therein for receipt of said suction cup.

5. The chair as defined in claim 4 wherein said suction cup has a hub portion on the rear surface thereof, said hub portion having a first dimension approximating the width of said longitudinally extending slot and a second dimension greater than said width of said longitudinally extending slot.

6. The chair as defined in claim 5 wherein said suction cup is laterally movable within said longitudinally extending slot when said first dimension of said hub of said suction cup is oriented along the axis of said longitudinally extending slot.

7. The chair as defined in claim 5 wherein said suction cup is secured within said longitudinally extending slot when said second dimension of said hub of said suction cup is oriented along the axis of said longitudinally extending slot.

* * * * *